US006409474B1

(12) United States Patent
Liang

(10) Patent No.: US 6,409,474 B1
(45) Date of Patent: Jun. 25, 2002

(54) CENTRIFUGAL PUMP FORMED BY PRESSING AND WELDING AND ITS MANUFACTURING PROCESS

(75) Inventor: Fang Liang, Northern of Yangjiang (CN)

(73) Assignee: Yangjiang New Yuehua Stainless Steel Pump Co. Ltd., Guandong (CN)

( * ) Notice: Subject to any disclaimer, the term of this patent is extended or adjusted under 35 U.S.C. 154(b) by 0 days.

(21) Appl. No.: 09/582,689

(22) PCT Filed: Oct. 30, 1998

(86) PCT No.: PCT/CN98/00261

§ 371 (c)(1),
(2), (4) Date: Aug. 25, 2000

(87) PCT Pub. No.: WO00/26541

PCT Pub. Date: May 11, 2000

(51) Int. Cl.[7] ..... F04D 29/54; F03B 3/16
(52) U.S. Cl. ..... 415/204; 415/215.1; 415/206
(58) Field of Search ..... 415/200, 206, 415/204, 215.1, 214.1, 212.1, 213.1

(56) References Cited

U.S. PATENT DOCUMENTS 5,069,599 A * 12/1991 Carretta ..... 415/182.1
5,112,190 A 5/1992 Kajiwara et al. ..... 415/215.1
5,235,744 A * 8/1993 Arakawa et al. ..... 29/888.02
5,358,380 A * 10/1994 Arakawa ..... 415/200

FOREIGN PATENT DOCUMENTS

| | | |
|---|---|---|
| CN | 1138670 A | 12/1996 |
| EP | 0 379 196 A2 | 7/1990 |
| EP | 0 406 868 A2 | 1/1991 |
| EP | 0 494 675 A2 | 7/1992 |

* cited by examiner

*Primary Examiner*—F. Daniel Lopez
*Assistant Examiner*—Kimya N McCoy
(74) *Attorney, Agent, or Firm*—Westman, Champlin & Kelly, P.A.

(57) ABSTRACT

The invention relates to a centrifugal pump and it's manufacturing process, more particularly to a pump formed by pressing and welding metal sheet. In this invention, comprising a pump casing, an impeller, labyrinth ring supports, labyrinth rings, a real cover and a chassis, characterized in that the manufacturing process of said pump casing includes following steps: using a female mold made by wear-resisting metal, the female space in said female mold is a near 360° integrated spiral with radial expanded gradually shape and approximately semicircle cross section, using a male mold made by pressing deformable soft or elastic material, putting a tubular member with flange made by metal sheet between said molds, closing said molds, expanding said male mold made by soft or elastic material. Said tubular member will be expanded into a near 360° integrated spiral casing with radial expanded gradually shape and approximately semicircle cross section.

6 Claims, 5 Drawing Sheets

CENTRIFUGAL PUMP FORMED BY PRESSING AND WELDING AND ITS MANUFACTURING PROCESS

TECHNICAL FIELD

This invention relates to a pump and its manufacturing process, more particularly to a centrifugal pump formed by pressing and welding metal sheets and its manufacturing process.

BACKGROUND ART

Pumps for industrial purposes are a kind of general mechanical product in great need, and they are applied to a variety of industrial fields. Pumps are ordinarily manufactured by casting, which is a power-consuming, material-consuming and labor-intensive process that is capable of environmental pollution. The manufacturing of some parts of the small-flow and high-lift pumps, for example, the small-flow, narrow-impeller, is impossible by casting owing to its processing limitations. Therefore, there is research on the production of impellers with metal sheets by the pressing and welding method in order to make the pressing centrifugal pump. In some of the conventional centrifugal pumps only the impellers are formed by simply pressing and projection welding the metal sheets while the pump casings are still made by casting. Consequently, the drawbacks of the conventional casting processing cannot be completely overcome, and the process is still hard, the technical performance is poor.

Herein the said invention is motivated in consideration of how to manufacture all the parts of the centrifugal pump by pressing and welding so as to abate environmental pollution, alleviate working intensity, improve the strength of the pump casing and its technical performance, and greatly enhance the operating efficiency of the pump.

The inventor of the present invention, according to his long exposure to such fields as the development, manufacturing and processing of the pressed products, has produced an original design based on repeated research and analysis, eventually making the present invention.

Aimed at the inadequacy of the present technology, an object of the invention is to provide a pump wholly manufactured by pressing and welding process. This is a pressed centrifugal pump characterized with high strength and high operating efficiency; the strength and the rigidity of the pump casing are good enough to bear the acting force of the pipeline and the internal pressure.

Another object of the invention is to provide a manufacturing process by which all the parts of a pump are formed by pressing and welding.

DISCLOSURE OF INVENTION

The purposes of the invention can be achieved as follows: the pump casing, the impeller, labyrinth ring supports, labyrinth rings, the rear cover and the chassis of the pump are formed by pressing. It is characterized in the manufacturing process as the following steps: an openable female mold is made of wear-resistant metal. The inside of the female mold takes an integrated spiral shape of approximately 360° and increases gradually radially outward; its cross section resembles roughly a semicircle. The internal male mold is made of pressing-deformable flexible or elastic material. The metal sheets are pressed into a tubular unit with flange, which will be inserted between the molds. Then the molds will be closed and the male mold made of the flexible or elastic material will expand so that the tubular unit will expand in the radial direction into a gradually increasing spiral case of approximately 360° , whose cross section resembles roughly a semicircle. The above-mentioned internal male mold can be made of polyurethane rubber as the flexible or elastic material.

The pump formed by pressing in the present invention consists of an entrance flange, a discharge flange, a rear cover, a pump casing, and an impeller, characterized in that there is an integrated spiral chamber of an approximate 360° whose cross section resembles roughly a semicircle that increases gradually radially outward in the flowing direction of the fluid between the pump casing and the impeller. Besides, there is a discharge aperture resembling an ellipse approximately, the discharge neck is joined to the discharge aperture of the pump casing.

The objectives of the present invention can be achieved through the following steps:

The axial outer surface of the joint between the pump casing and the entrance flange is a camber with a gradually increasing curvature;, the axial curvature varies in connection with the radial extending height. The larger the radial extension, the smaller the axial curvature, which makes the thickness of the plate of the various parts of the pump casing more uniform during the pressing process. Therefore, the pressure from the pipeline is more evenly sustained and at the same time the rigidity and the intensity of the pump casing display the optimum state.

The discharge neck at the aperture of the pump casing is welded on the pump casing; it resembles an ellipse and its diameter can vary. This meets the requirements of the flowing cross section of the fluid and can reduce resistance and noise, thus promoting the efficiency.

At least two evenly distributed ribs are joined to the pump casing and the entrance flange, evenly distributing the pipeline pressure onto the surface of the pump casing, and strengthening the intensity of the entrance flange. The cross section of the rib is U-shaped. It has a high stiffness and can save materials.

There are labyrinth ring supports in the pump casing which connect and support the inner side and outer side of the location where both the ribs of the entrance flange and the labyrinth ring supports sustain the pump casing, so as to make the ribs and the labyrinth supports sustain each other and also to enhance the strength of the pump casing.

The impeller comprises a front impeller plate, a rear impeller plate, and a spiral blade sandwiched between the two plates. This structure can effectively increase the strength of the impeller blade.

The space between the impeller entrance and the pump casing entrance is sealed by the labyrinth rings located in the labyrinth ring supports. In this way, the clearance between the sealing surfaces of the static-dynamic sealing is less than 0.5 millimeter, and the effect is good.

To summarize what is mentioned above, the technical characteristics of the present invention can be described as follows:

1. All the parts of the centrifugal pump are formed by pressing and welding with a simple process, by which all the parts of the centrifugal pump are made of the metal sheets with a thickness ranging from 0.5 mm to 5 mm. Compared with the same-type pump formed by casting, the weight of the said pump is a quarter of, its efficiency is 5–7% higher than, and its cost is two thirds of that of the latter. The pump saves energy and materials, its working efficiency high. The use of it can avoid environmental pollution and alleviate working intensity. The metal sheets can be made of stainless steel plates, which are rot-resistant and lasting. It can transfer heavily viscous fluid and can operate in the acid, alkali and other corrosive media in the temperature ranging from −40° C. to 180° C.

2. The manufacturing processing is subtly designed. The structure of the impeller overcomes the difficulty unsolved by the centrifugal pump formed by casting with a rotating speed Ns lower than 30 and a discharge aperture of 1–2 mm in width. The thickness of the pump casing formed by pressing is uniform; it is of an uneven, asymmetrical, spiral shape, which is more suitable for the flow of the fluids. The static-dynamic sealing between the impeller entrance and the casing entrance is sealed by labyrinth rings with a sealing clearance smaller than 0.5 mm. The discharge neck is welded on the pump casing; the welding shape resembles an ellipse and its diameter varying, leaving no scar.

3. The strength and the intensity of the centrifugal pump casing are both at their optimum states. The casing can sustain the maximal acting force from the pipeline and the internal pressure. It is widely applicable in the sites of the small-flow, high-lift transfer of fluid under pressure.

BEST MODE FOR CARRYING OUT THE INVENTION

Figure 4B:
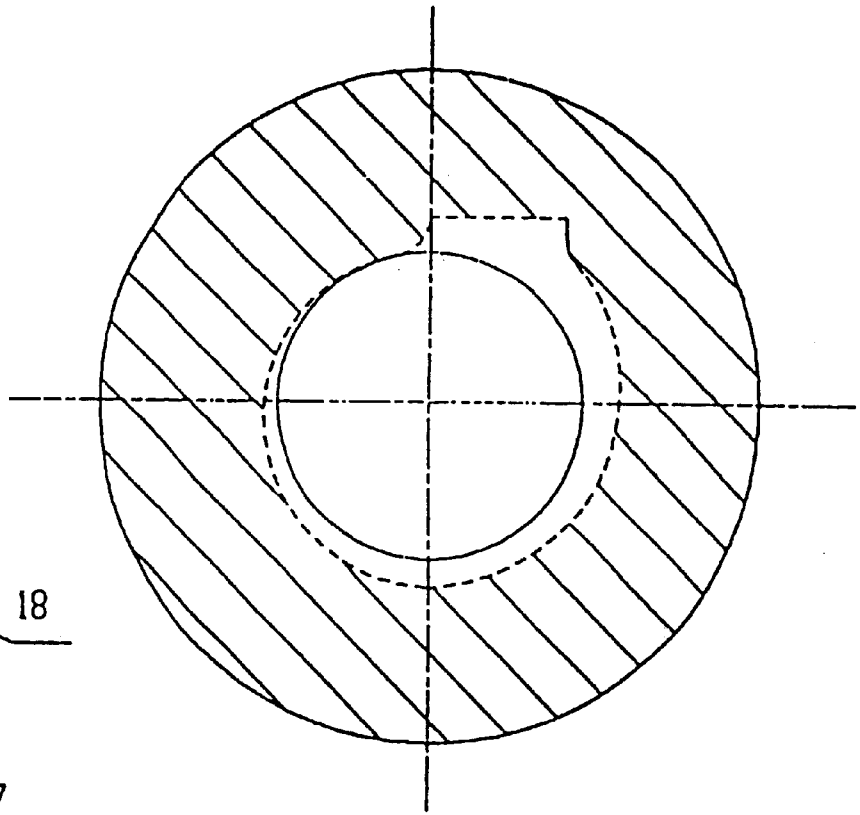
FIGS. 4*a*–4*b* is a schematic view showing the structure of the processing molds for the manufacture of the casing of the centrifugal pump according to the present invention.
Figure 4A:
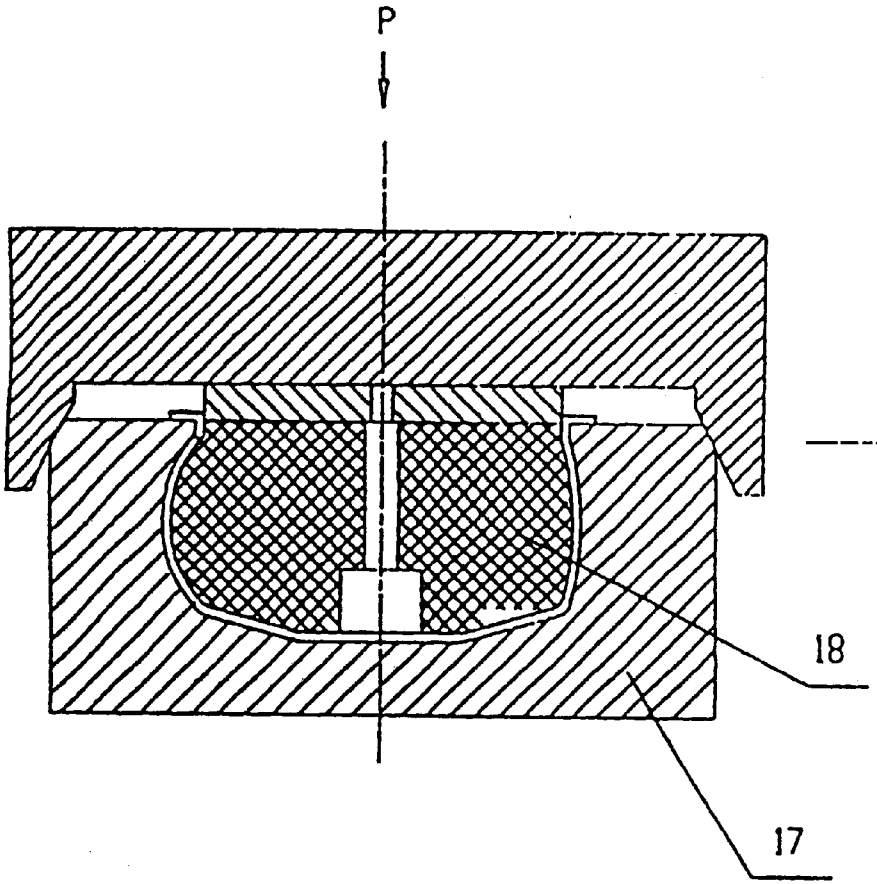
Figures 5A, 5B, 5C, 5D:
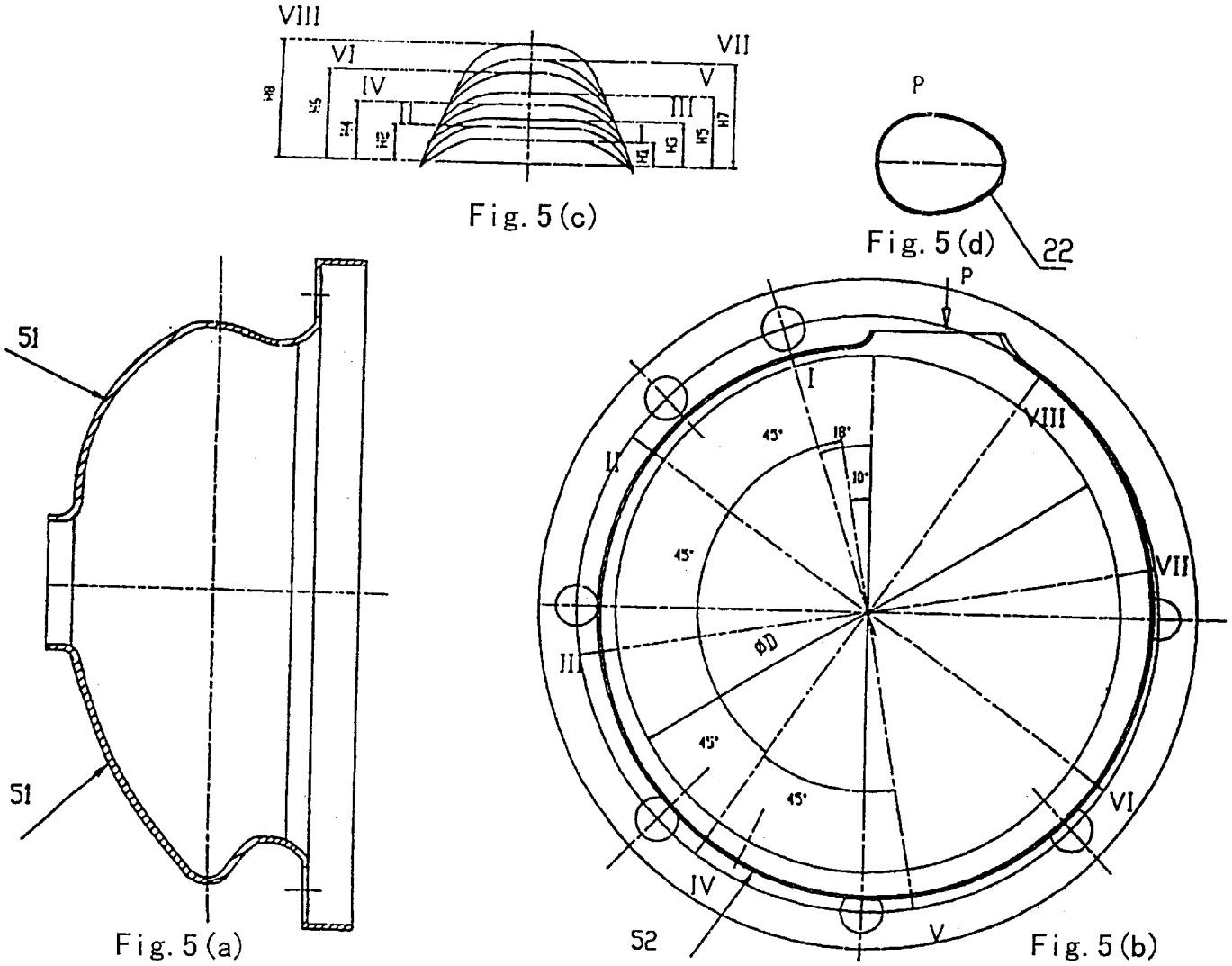
FIGS. 5*a*–5*d* is a view of the pump casing produced in accordance with the present invention.
Figures 6A, 6B, 6C, 6D, 6E, 6F:
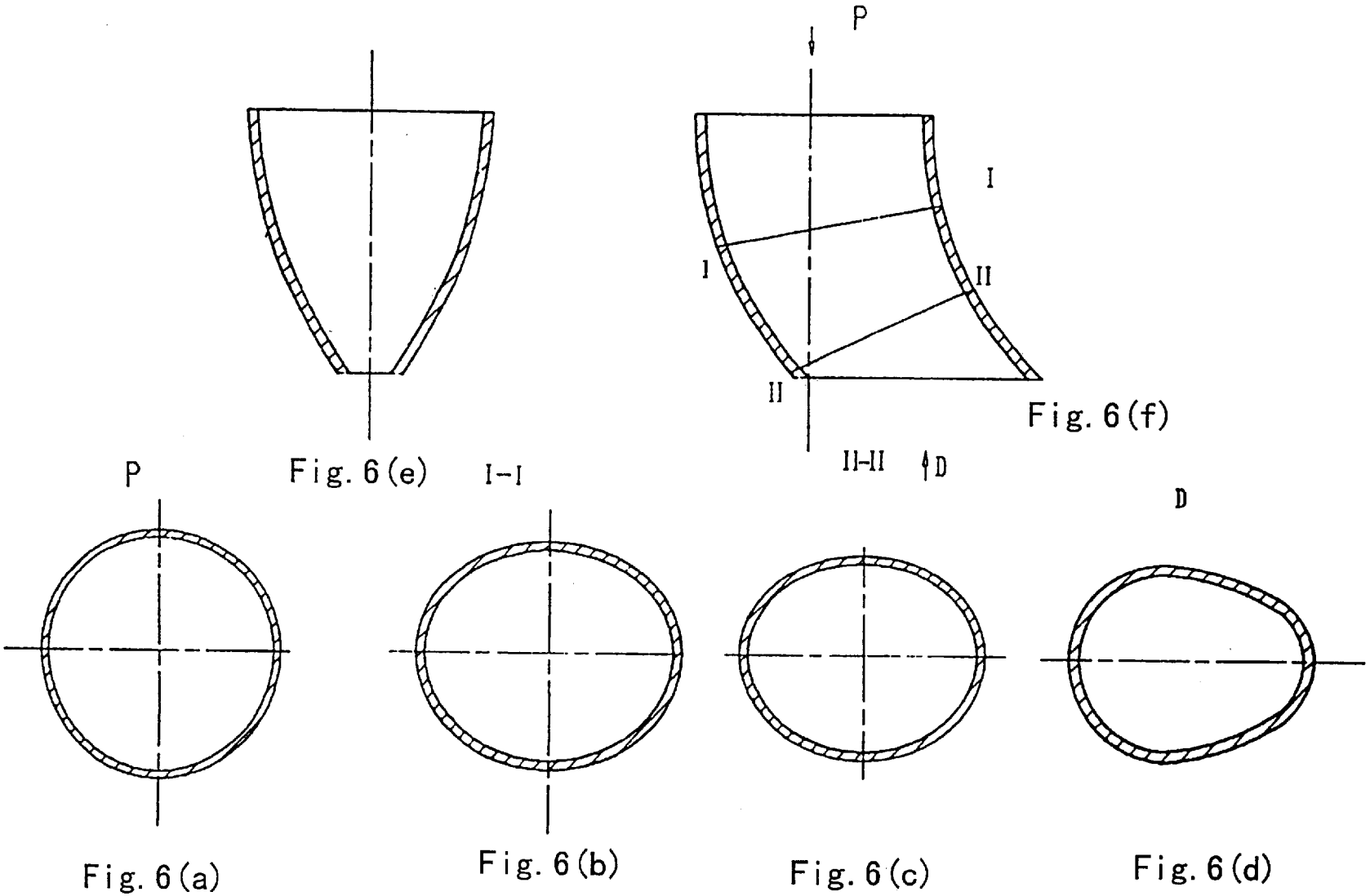
FIGS. 6*a*–6*f* illustrates the connection of the discharge aperture neck of the present invention.

The pump casing 1, the impeller 2, the labyrinth ring supports 10, the labyrinth rings 4, the rear cover 5 and the chassis 11 are formed by pressing, as shown in FIG. 4. The manufacturing process of the pump casing in the present invention is as follows: an openable female mold 17 is made of wear-resistant metal. The female mold takes a spiral shape of approximately 360°; its cross section resembles roughly a semicircle that increases gradually radially outward. An internal male mold 18 is made of pressing-deformable flexible or elastic material, which can be polyurethane rubber. The metal sheets of 0.5–5 mm in thickness are pressed into a tubular unit with flange, which will be inserted between the molds. Then the molds will be closed and the male mold made of the flexible or elastic material will expand so that the tubular unit will expand in the radial direction into a gradually increasing spiral case of approximately 360°, whose cross section resembles roughly a semicircle. As shown in FIG.5, the radial cross section 52 of the pump casing 1 should be made into a gradually opening spiral shape from the beginning I to VIII in the radial direction. The axial surface 51 at the feed end is a camber with a gradually increasing curvature; the axial curvature varies in connection with the radial extending height. The larger the radial extension, the smaller the axial curvature, which makes the fluid-passing cross section of the impeller 2 vary more evenly and the thickness of the metal plates at the feed end more uniform. Both the rigidity and the intensity of the pump casing are enhanced.

Figure 1:
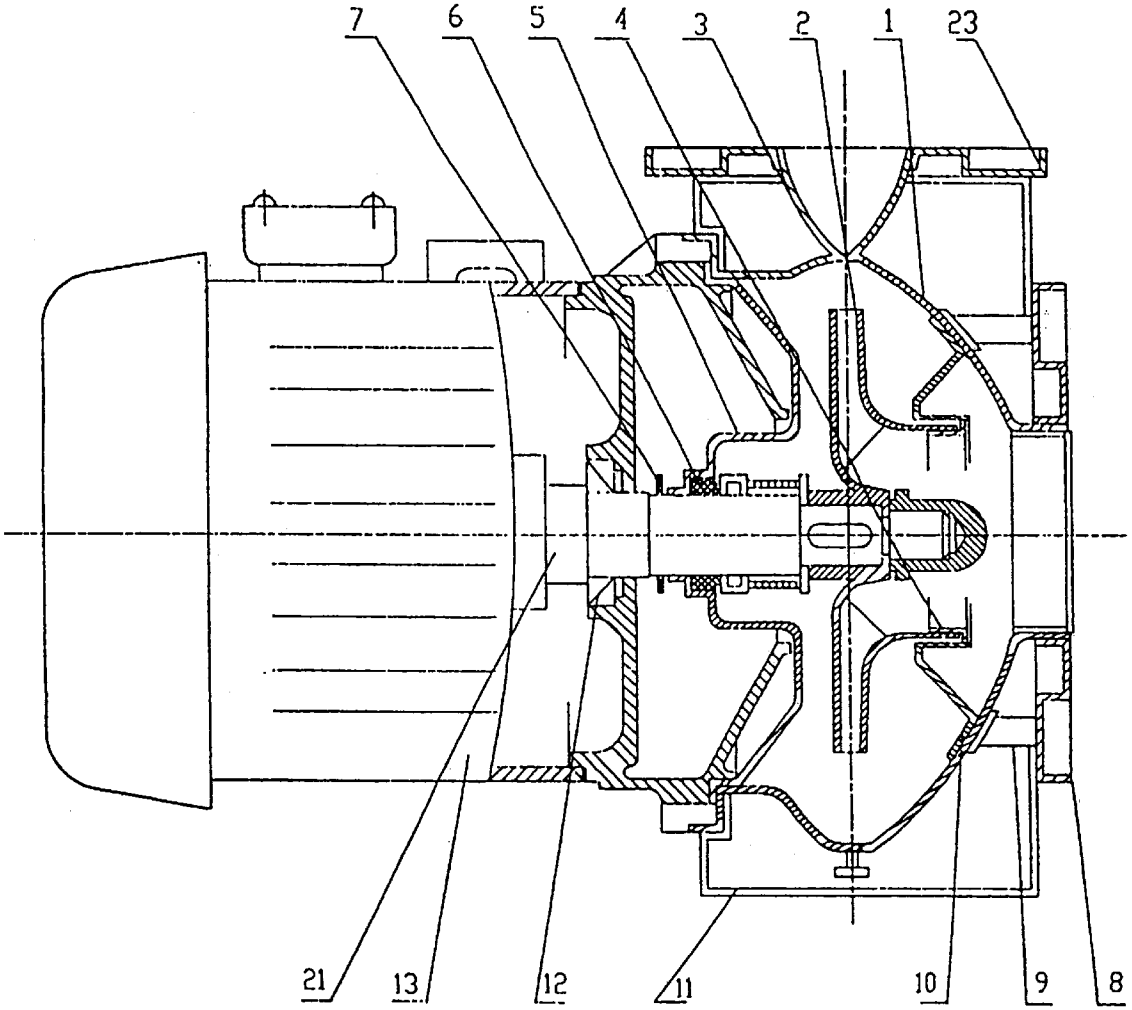
FIG. 1 is a schematic view showing the structure of the centrifugal pump according to the present invention.
Figure 2:
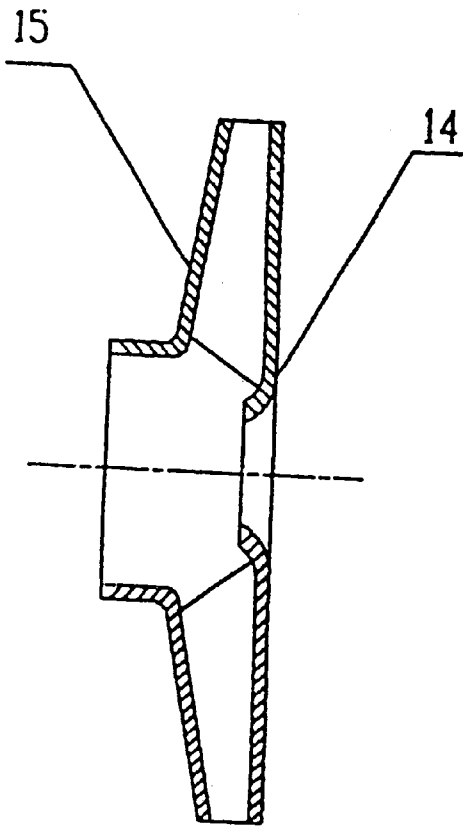
FIG. 2 is a schematic view showing the structure of the impeller of the centrifugal pump according to the present invention.
Figure 3:
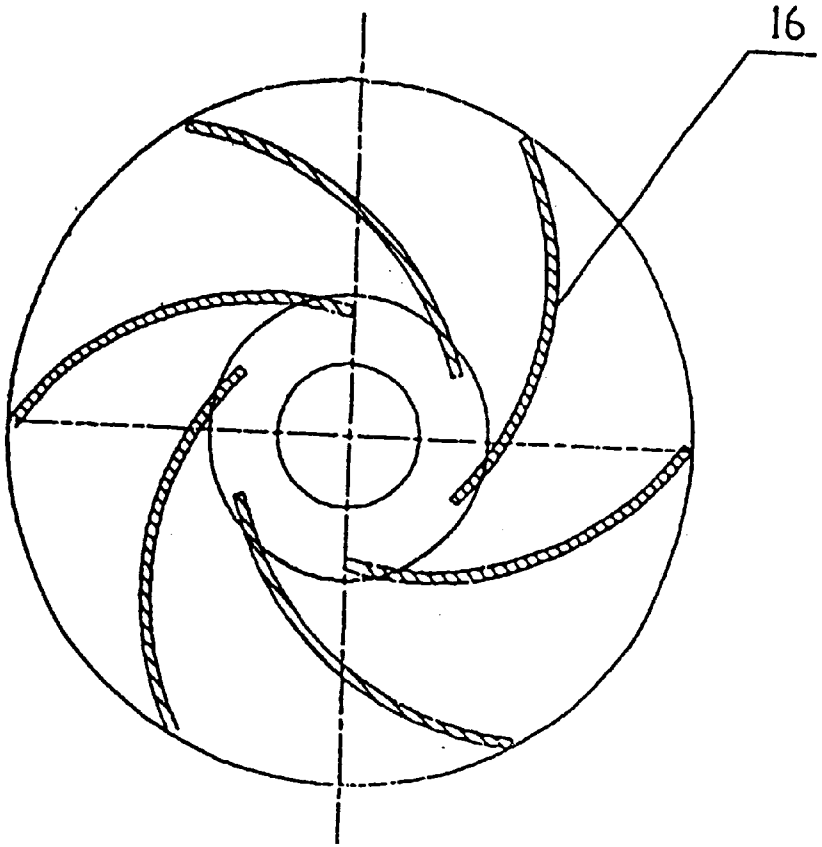
FIG. 3 is a cutaway view of the impeller of the centrifugal pump according to the present invention.

As shown in FIG. 1, the centrifugal pump of the present invention consists of a pump casing 1, an impeller 2, labyrinth ring supports 10, labyrinth rings 4, a rear cover 5, a pump axis 21, a chassis 11, an entrance flange 8 and an discharge flange 23. In the center of the pump there is a pump axis 21, which shares the same axis with the motor 13; the pump casing 1 is provided with flanges connected to the motor. In the pump casing 1 there is an integrated spiral chamber of approximately 360°, which is pressed between the pump casing 1 and the impeller 2. The spiral chamber gradually increases radially outward in the fluid-flowing direction; its cross section roughly resembles a semicircle. There is also an aperture 22 roughly shaping as an ellipse (See FIG. 5); the discharge aperture neck 3 is connected to the discharge aperture 22 of the pump casing. The impeller comprises the front impeller plate 15, the rear impeller plate 14 and the spiral blade 16 sandwiched between the two plates. It is welded into a narrow-flowing impeller by protruding contact (See FIG. 2 and FIG. 3). The space between the entrance of the impeller and the entrance of the pump casing is sealed with the labyrinth rings 4 located in the labyrinth ring supports 10. The pump axis 21 passing through the center of the rear cover 5 is supported by the bearing 12, and there are installed also combined mechanical seal 6 and the breakwater ring 7. The front end of the pump axis inserts into the center of the pump casing and fixedly connects to the impeller. The pump casing is fixed by bolts to the casing cover of the motor, which shares the same axis with the pump. The labyrinth ring supports 10, the discharge aperture neck 3, and the chassis 11 are welded on the pump casing by protruding contact. The discharge aperture neck 3, shaped as a diametrically-variable ellipse, connects to the aperture 22 in the pump casing 1. The rib 9 is connected to the outer side of the joint of the labyrinth ring supports 10 and the pump casing 1, with which the labyrinth ring supports are connected at the inside and outside of the same place on the pump casing so as to form a mutual support. At least two evenly-distributed ribs 9 are connected to the entrance flange 8.

In summary, the present invention provides a centrifugal pump formed by pressing and welding with its effectiveness, feasible processing, sound structure and excellent performance. It is obvious that the present invention posses novelty, inventiveness and practical applicability. What is mentioned above is the actual embodiment of this new process and its technical principles. It should be noted that, any equivalent change that does not deviate from these technical principles, when the functions it produces don't surpass the spirit included in this description and the drawings, should be considered within the range of the present invention.

INDUSTRIAL APPLICABILITY

The present invention provides a centrifugal pump formed by pressing and welding, which can take the place of the pump formed by casting. It solves the problem that the small-flow, narrow-impeller pump is hard to cast. The manufacturing process and the structure provided in the present invention secure the centrifugal pump with a relatively high strength and rigidity. The thickness of the pump casing is more uniform, and the acting force from the pipeline can be evenly distributed on the casing surface. An integrated spiral chamber is pressed between the pump casing and the impeller. The chamber is asymmetrical, uneven, and gradually increases in the flowing direction of fluid. This design conforms more to fluid mechanics and the pump can sustain higher internal pressure and become more efficient. It is especially suitable for the great-flow, high-lift transfer of clean water and viscous fluid. The advantages of the present invention are as follows: compared with the pump formed by casting, its weight is three quarters lighter, and its efficiency 5–7% higher. It can greatly save the material and energy, cut one third of the cost, and reduce the environmental pollution.

What is claimed is:

1. A centrifugal pump formed by pressing and welding, consisting of an entrance flange, a discharge flange, a rear cover, a pump casing, and an impeller, characterized in that in the pump casing there is an integrated spiral chamber of approximately 360° pressed between the pump casing and the impeller, the chamber gradually increasing radially outward in the flowing direction of the fluid, its cross section being roughly a semicircle, there also being a discharge aperture roughly shaped as an ellipse, the discharge aperture neck being connected to the discharge aperture of the pump casing, the discharge aperture neck of the pump casing is welded on the discharge aperture of the pump casing with a diametrically-variable ellipse shape, the axial outer surface at the joint of the pump casing and the entrance flange is a camber with a gradually varying curvature, the curvature of the axial outer surface of the pump casing varies in connection with the radially extending height, the larger the radial extension, the smaller the axial curvature, in the pump casing there is labyrinth ring supports, which connect and support the inner side and outer side of the place where both the ribs of the entrance flange and the labyrinth ring supports sustain the pump casing.

2. A centrifugal pump formed by pressing and welding according to claim 1, characterized in that at least two evenly distributed ribs join the pump casing to the entrance flange.

3. A centrifugal pump formed by pressing and welding according to claim 1, characterized in that said impeller consists of a front impeller plate, a rear impeller plate and a spiral impeller blade sandwiched between said two plates.

4. A centrifugal pump formed by pressing and welding according to claim 1, characterized in that between the entrance of the impeller and the pump casing there are labyrinth rings located in the labyrinth ring supports for the purpose of sealing.

5. A manufacturing process of a centrifugal pump formed by pressing and welding, by which the pump casing, the impeller, the labyrinth supports, the labyrinth rings, the rear cover and the chassis are formed by pressing, characterized in that the manufacturing process of the pump casing is as follows: an openable female mold is made of wear-resistant metal, the inside of the female mold takes an integrated spiral shape of approximately 360°, its cross section resembles roughly a semicircle that gradually increases radially outward, the internal male mold is made of pressing-deformable flexible or elastic material, the metal sheets are pressed into a tubular unit with flange, which will be inserted between the molds, then the molds will be closed and the male mold made of the flexible or elastic material will expand so that the tubular unit will expand in the radial direction into a gradually increasing integrated spiral case of approximately 360°, whose cross section resembles roughly a semicircle.

6. The manufacturing process of a centrifugal pump formed by pressing and welding according to claim 5, characterized in that the flexible and elastic material made into the internal mold is polyurethane rubber.

* * * * *